US005333788A

United States Patent [19]

Hadar

[11] Patent Number: 5,333,788

[45] Date of Patent: Aug. 2, 1994

[54] BALL-TYPE WATER SPRINKLER

[75] Inventor: Yoram Hadar, Haifa, Israel

[73] Assignee: Lego M. Lemelshtrich Ltd, Natania, Israel

[21] Appl. No.: 34,983

[22] Filed: Mar. 22, 1993

[30] Foreign Application Priority Data

Mar. 23, 1992 [IL] Israel ..... 101334

[51] Int. Cl.[5] ..... B05B 3/04

[52] U.S. Cl. ..... 239/241; 239/513

[58] Field of Search ..... 239/203–206, 239/237–242, 513

[56] References Cited

U.S. PATENT DOCUMENTS

| | | | |
|---|---|---|---|
| 2,816,798 | 12/1957 | Royer | 239/239 X |
| 2,973,149 | 2/1961 | Kachergis | 239/513 X |
| 4,353,506 | 10/1982 | Hayes | 239/513 X |
| 4,625,914 | 12/1986 | Sexton et al. | 239/242 X |
| 4,687,139 | 8/1987 | Lockwood | 239/240 X |
| 4,784,329 | 11/1988 | Heren | 239/513 X |
| 4,927,082 | 5/1990 | Greenberg et al. | 239/242 X |

*Primary Examiner*—Andres Kashnikow
*Assistant Examiner*—Kevin P. Weldon
*Attorney, Agent, or Firm*—Benjamin J. Barish

[57] ABSTRACT

A ball-type water sprinkler includes a ball freely movable within a chamber formed in a rotor and having two water inlets oriented to direct the water to flow circumferentially of the chamber in opposite directions, an impact element fixed to the rotor so as to be impacted by the ball and to rotate the rotor according to the direction of rotation of the ball; a fixed stop fixed with respect to a mounting device; and a presettable stop circumferentially presettable with respect to the fixed stop and carried by a rotatable ring interposed between the mounting device and the rotor.

14 Claims, 4 Drawing Sheets

FIG.2a
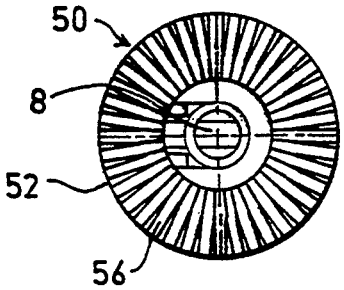
FIG.3
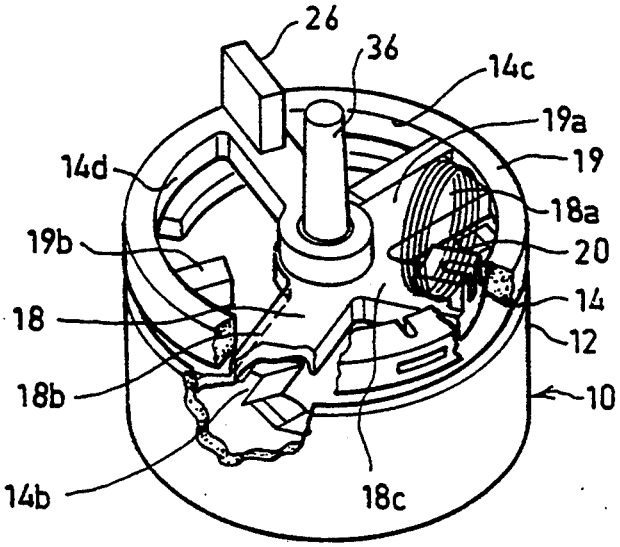
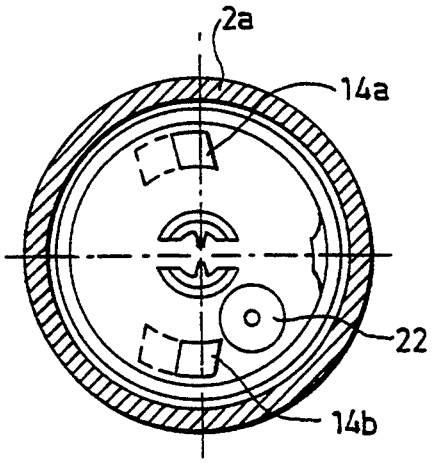
FIG 2b
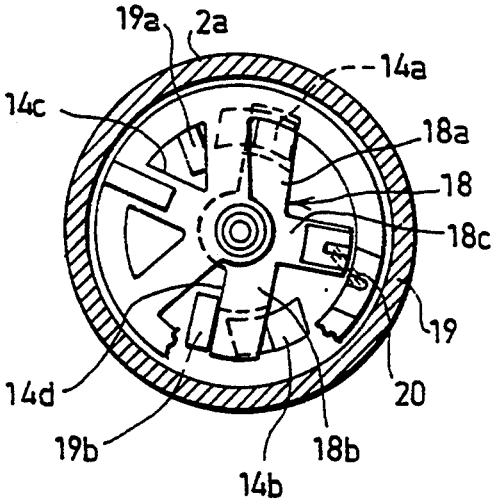
FIG 2c

BALL-TYPE WATER SPRINKLER

FIELD AND BACKGROUND OF THE INVENTION

The present invention relates to ball-type water sprinklers, and particularly to the selector-type sprinkler described in our U.S. Pat. No. 4,927,082.

Our U.S. Pat. No. 4,927,082 describes a ball-type water sprinkler comprising a mounting device for mounting the sprinkler to a water supply pipe and a rotor mounted for rotation with respect to the mounting device and to receive water therefrom. A chamber formed in the rotor has a first water inlet oriented to direct the water to flow circumferentially of the chamber in a first direction, a second water inlet oriented to direct the water to flow circumferentially thereof in the opposite direction, and an outlet from the chamber. A ball is freely movable within the chamber according to the direction of flow of the water therethrough; and an impact element fixed to the rotor within the chamber is impacted by the ball and thereby rotates the rotor according to the direction of rotation the ball. The sprinkler further includes a stop fixed with respect to the mounting device; a stop circumferentially presettable with respect to the fixed stop; a shutter rotatable with the rotor and movably mounted with respect thereto to a first position covering the first inlet and uncovering the second inlet, or to a second position covering the second inlet and uncovering the first inlet. Actuator means rotatable with the shutter engages the fixed stop to move the shutter to the first position, and engages the presettable stop to move the shutter to the second position.

OBJECTS AND BRIEF SUMMARY OF THE INVENTION

An object of the present invention is to provide a sprinkler of the foregoing type but modified to provide a more compact and less expensive construction.

According to one feature in the present invention, there is provided a ball-type sprinkler as described above characterized in that the presettable stop is carried by a rotatable ring interposed between the mounting device and the rotor. In addition, the actuator means includes an actuator element extending axially of the sprinkler and engageable with the fixed stop to move the shutter to the first position, and with the presettable stop to move the shutter to the second position. This is to be contrasted with the sprinkler described in our above U.S. Pat. No. 4,927,082 wherein the presettable stop is carried by an externally-extending fingerpiece at the upper end of the sprinkler housing, and the actuator means is an actuator element extending radially of the sprinkler so as to be engagable with either the fixed stop or the presettable stop.

According to further another feature in the present invention, the actuator means includes an actuator disc having a first projection extending axially from one side of the disc and received within a first opening in the rotor for coupling the actuator disc to the rotor during the rotation of the rotor in one directon. The actuator disc has a second projection extending axially from the same side of the disc and received within a second opening in the rotor for coupling the actuator disc to the rotor during the rotation of the rotor in the opposite direction. The actuator element in the actuator disc is a third projection extending axially from the opposite side of the disc and engageable with the first and second stops.

The foregoing features are to be contrasted with the sprinkler described in our U.S. Pat. No. 4,927,082 wherein the coupling between the actuator disc and rotor are in the form of radially-extending (rather than axially-extending) projections on the actuator disc.

It has been found that a ball-type sprinkler constructed in accordance with one or both of the foregoing features enables the sprinkler to be constructed more compactly and less expensively.

According to one preferred embodiment of the invention described below, the sprinkkler includes a housing fixed to the mounting device and enclosing the rotor, the fixed stop being fixed to the housing.

However, according to a second described embodiment, the sprinkler does not include a housing, and the fixed stop is fixed to the mounting device itself. The latter construction can be built even more compactly than the first-described embodiment.

Further features and advantages of the invention will be apparent from the description below.

BRIEF DESCRIPTION OF THE DRAWINGS

The invention is herein described, by way of example only, with reference to the accompanying drawings, wherein:

FIGS. 2*a*, 2*b* and 2*c* are sectional views along lines A—A, B—B and C—C, respectively, of FIG. 2;

FIG. 3 is an enlarged perspective view of the interior of the sprinkler of FIGS. 1 and 2;

DESCRIPTION OF PREFERRED EMBODIMENTS

Figure 1:
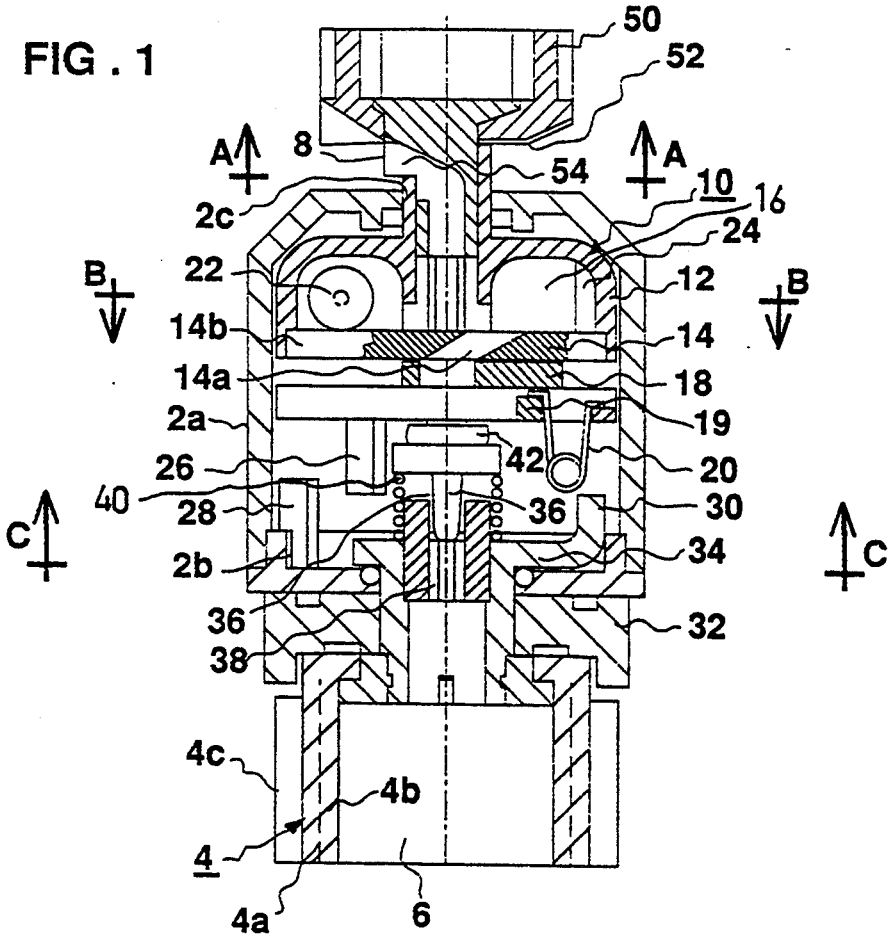
FIG. 1 is a side elevational view illustrating one form of sprinkler constructed in accordance with the present invention.
Figure 2:
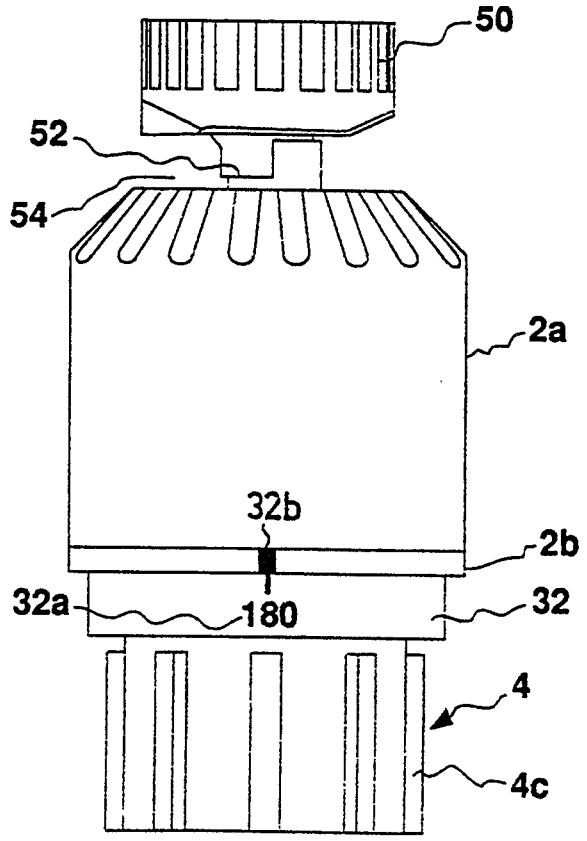
FIG. 2 is a longitudinal sectional view of the sprinkler of FIG. 1.

The sprinkler illustrated in FIGS. 1–3 of the drawings comprises a housing, generally designated 2, which is mounted by a mounting assembly 4 to a water supply pipe 6. The mounting assembly 4 includes a nut 4*a* formed with internal threads 4*b* for mounting the assembly to the water supply pipe 6 . Nut 4*a* further includes external ribs 4*c* facilitating the manual rotation of the nut, and an apertured end wall 4*d* interposed between the nut and the end of the water supply pipe 6.

Sprinkler housing 2 includes a main section 2*a* closed at one end by an apertured bottom wall 2*b* through which the water is inletted from the water supply pipe 6 via the mounting device 4, and an outlet opening 2*c* at its upper end receiving a discharge nozzle 8 through which the nozzle is discharged laterally of the sprinkler.

Nozzle 8 is coupled to a rotor assembly, generally designated 10, disposed within housing 2. Rotor assembly 10 includes a rotor 12 closed by a bottom wall 14 so as to define an annular chamber 16. Bottom wall 14 is formed with two inlets 14*a*, 14*b* leading into annular chamber 16 of rotor 12. Water inlet 14*a* is oriented to direct the water to flow circumferentially of the annular chamber 16 in a first direction, and water inlet 14*b* is oriented to direct the water to flow circumferentially of the chamber in the opposite direction.

The direction of flow of the water through chamber 16 is controlled by a shutter 18 which is selectively positionable to open one or the other of the two inlets 14*a*, 14*b*. Shutter 18 is of a T-configuration, as shown particularly in FIG. 2*c*. It includes one leg 18*a* adapted to cover or uncover inlet opening 14*a* into chamber 16, a second leg 18*b* adapted to cover or uncover the second inlet opening 14*b* into chamber 16, and a third leg 18*c* pivotally mounting the shutter to an actuator disc 19 by means of an overcenter spring 20 (FIG. 3). The pivotal mounting of the shutter permits the shutter to be moved either to a first position (shown in FIG. 2*c*) covering inlet 14*a* and uncovering inlet 14*b*, or to a second position covering inlet 14*b* and uncovering inlet 14*a*.

Actuator disc 19 includes a first projection 19*a* extending axially from one side of the disc and receivable within a triangularly-shaped opening 14*c* formed in bottom wall 14 of the rotor 12 for coupling the actuator disc to the rotor during the rotation of the rotor in one direction. The actuator disc 19 includes a second projection 19*b* extending axially from the same side of the disc and received within another triangularly-shaped opening 14*d* in bottom wall 14 of the rotor for coupling the actuator disc to the rotor during the rotation of the rotor in the opposite direction.

Rotor assembly 10 further includes a ball 22 freely movable within chamber 16 so as to be rotated in that chamber according to the direction of flow of the water, as determined by which of the two inlets 14*a*, 14*b* is opened by shutter 18. An impact element 24 is fixed to the rotor 12 within its chamber 16 so as to be impacted by the ball 22, and thereby to rotate the rotor according to the direction of rotation of the ball.

Actuator disc 19 includes a further projection 26 which extends axially from the opposite side of the disc as its projections 19*a*, 19*b*. Projection 26 cooperates with a stop 28 fixed to the bottom wall 2*b* of housing 2. Stop 28 extends axially of the housing so as to be engageable by projection 26 carried by the actuator disc during the rotation of the rotor assembly 10 in one direction.

The sprinkler further includes a second, presettable stop 30 carried by a sleeve 34 fixed to a rotary ring 32 interposed between the mounting assembly 4 and the sprinkler housing 2. Ring 32 is rotatably mounted so that it may be manually rotated to preset its stop 30 at any angular position with respect to the fixed stop 28. As will be described more particularly below, this presetting of stop 30 by rotation of ring 32 presets the sector angle to be traversed by the sprinkler before it reverses its direction of rotation. Ring 32 may be provided with indicia, such as shown at 32*a* in FIG. 2, cooperable with a reference mark 32*b* on the housing 2, to indicate the preset sector angle.

Actuator disc 19 further includes a stem 36 extending axially of the disc from the same side as its projection 26 (i.e., from the opposite side of its rotor-coupling projections 19*a*, 9*b*). Stem 36 is received within sleeve 34 fixed to the presettable ring 32 and is spaced from the inner surface of the sleeve by a plurality of axially-extending ribs 38 to assure continuous communication between the water supply pipe 6 and the interior of the housing 2. The actuator disc 19 and shutter are both urged against the rotor assembly 10, and the rotor assembly is also urged against the top wall of the housing 2, by a coiled spring 40 interposed between a collar 42 and sleeve 34.

The illustrated sprinkler further includes range presetting means for presetting the range of the discharged water. The range discharging means includes a presettable cap 50 which is rotatably mounted on the end of the sprinkler housing 2 adjacent its discharge nozzle 8. Cap 50 has an apertured end wall 52 aligned with the open end of the housing receiving the discharge nozzle 8 and defining a discharge slot 54 therewith. End wall 52 is cut according to a helical configuration and is formed with a varying inclination with respect to the transverse axis of the sprinkler, such that rotation of cap 50 changes the inclination of the upper surface of the discharge slot 54. This in turn changes the range of the water discharged from the sprinkler.

As shown particularly in FIG. 2*a*, end wall 52 of the presettable cap 50 is formed with a plurality of radially-extending ribs 56. These ribs tend to bunch the water into streams, thereby further extending the range of the sprinkler.

The sprinkler illustrated in FIGS. 1—3 operates as follows:

The range of the sprinkler may first be preset by manually rotating cap 50 so as to preset the inclination the upper surface of the discharge slot 54, and thereby the range of the sprinkler. In addition, the sector angle may be preset by manually rotating ring 32, which in turn rotates the presettable stop 30 with respect to the fixed stop 28.

It will be assumed that shutter 18 is initially in the position illustrated in FIG. 2*b*, wherein its leg 18*a* covers inlet 14*a*, and its leg 18*b* uncovers inlet 14*b*.

The water inletted via the supply pipe 6 thus passes into the annular chamber 16 of the rotor assembly 10 through inlet opening 14*b*, which opening is oriented in the direction to rotate the ball 22 within the chamber in the counter-clockwise direction as seen in FIG. 2*b*. As the ball impacts against impact element 24 within chamber 16, the rotor assembly 10 is also rotated in the counter-clockwise direction while the water is discharged via nozzle 8.

The rotation of the rotor assembly 10 also rotates actuator disc 19 by the engagement of its projection 19*a* with the side of opening 14*c* in the bottom wall 14 of the rotor 12. The rotation of the rotor assembly 10 also rotates shutter 18 via its coupling to the actuator ring by the over-center spring 20. Projection 26 carried by the actuator disc 19 is thus advanced towards the fixed stop 28 fixed to housing 2. When projection 26 engages the fixed stop 28, the further rotation of the actuator disc is arrested, but the rotor assembly 10 continues to rotate slightly until the over-center spring 20 is actuated to snap shutter 18 to its second position, wherein its lege 18*a* uncovers inlet opening 14*a* and covers inlet opening 14*b*. This reverses the direction of flow of the water through chamber 16, and thereby the direction of rotation of the rotor assembly 10, so that the rotor now rotates in the clockwise direction.

The rotor will continue to rotate in the clockwise direction with its shutter 18 and actuator disc 19 until the projection 26 carried by the actuator disc 19 engages the presettable stop 30 . When this occurs the snap-action spring 20 will again be actuated to move the shutter, with a snap-action, to its original position wherein its leg 18*a* covers inlet 14*a*, and its leg 18*b* uncovers inlet 14*b*, thereby again reversing the direction of rotation of the rotor assembly 10.

Figure 4:
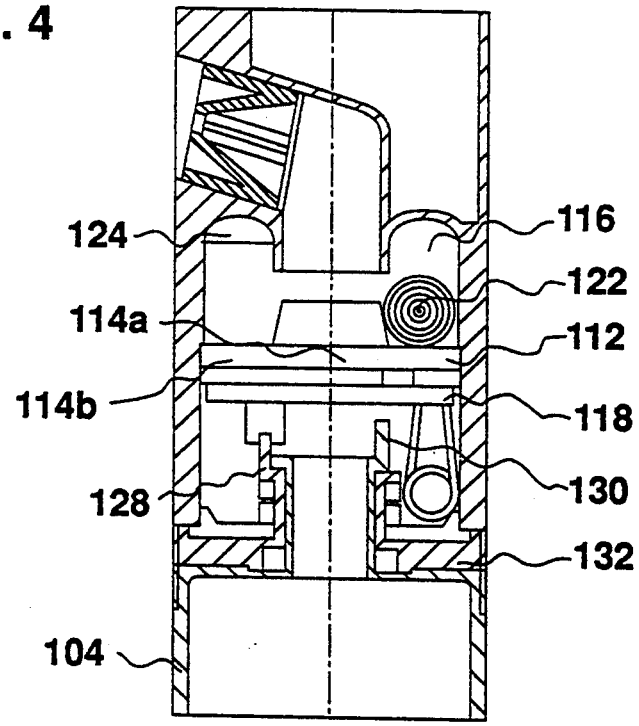
FIG. 4 is a longitudinal sectional view illustrating a second form of sprinkler constructed in accordance with the present invention.

FIG. 4 illustrates the main elements of a sprinkler constructed as described above with respect to FIGS. 1–3, except that the outer housing 2 is omitted. Thus, the rotor, therein designated 112, constitutes the outer wall of the sprinkler and is rotated according to the direction of rotation of ball 122 in its annular chamber 116, which in turn depends on which inlet opening, 114*a* or 114*b*, is opened by the shutter 118.

The sprinkler of FIG. 4 also includes a presettable ring 132, interposed between the mounting assembly 104 and the sprinkler housing. Ring 132 moves a presettable stop 130 to a selected angular distance with respect to a fixed stop 128, but in this case, the rotor 112 is the sprinkler housing and the fixed stop 128 is fixed to the mounting assembly 104.

Another change included in the sprinkler illustrated in FIG. 4 relates to the impact surface 124 in the annular chamber 116 of the rotor assembly. Thus, whereas the impact surface 24 in the sprinkler of FIGS. 1–3 extends radially from an axially-extending surface of chamber 16, in the construction of FIG. 4 the impact element 124 extends axially from a radially-extending surface of the chamber wall. As a result, whereas the rotation of the sprinkler of FIGS. 1–3 will deflect the ball in the inward radial direction, the rotation of the sprinkler of FIG. 4 will deflect the ball in the axial direction.

Another variation in the sprinkler of FIG. 4 is that it omits the range presetting cap 50 included in the sprinkler of FIGS. 1–3.

In all other respects, the sprinkler of FIG. 4 is constructed, and operates, in substantially the same manner as described above with respect to FIGS. 1–3. Among the advantages of the sprinkler of FIG. 4, over that of FIGS. 1–3, is an even simpler and more compact construction which can be produced in volume and at lower cost.

Figure 5:
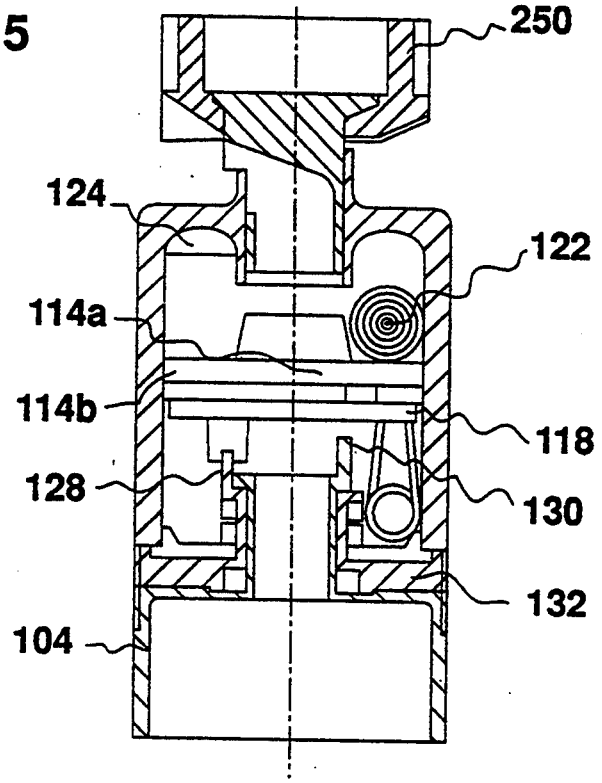
FIG. 5 is a longitudinal sectional view illustrating a third form of sprinkler constructed in accordance with the present invention.

FIG. 5 illustrates another sprinkler which is very similar to that of FIG. 4, except that the sprinkler of FIGS. 5 does include a presettable cap, therein designated 250, corresponding to cap 50 in FIGS. 1–3, for presetting the range of the sprinkler. In all other respects, the sprinkler of FIG. 5 is constructed, and operates, in substantially the same manner as described above with respect to FIG. 4.

Figure 6:
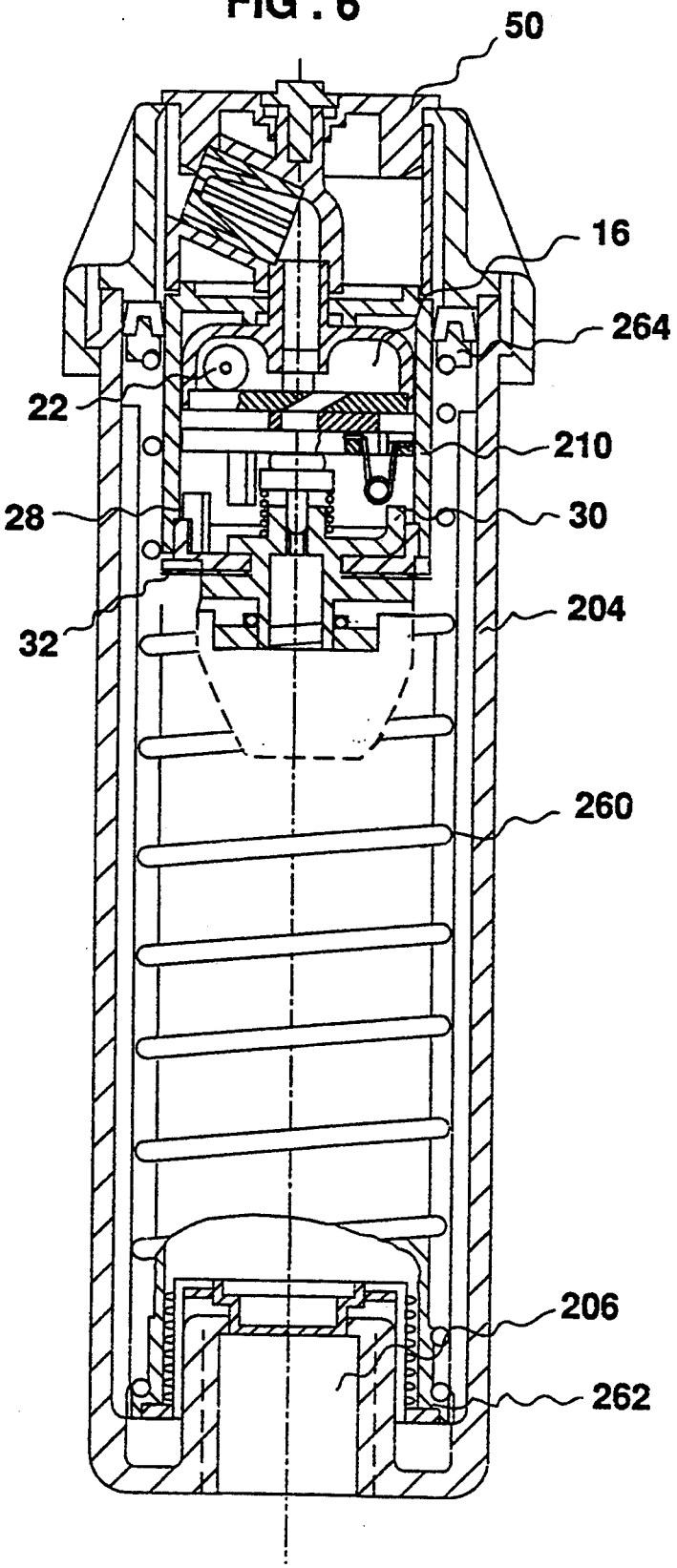
FIG. 6 is a longitudinal sectional view illustrating a pop-up sprinkler constructed in accordance with the present invention.

FIG. 6 illustrates the invention embodied in a pop-up sprinkler. Thus, the rotor assembly, generally designated 210, is axially displaceable within an elongated housing 204 so as to pop-up from the ground level when pressurized water is applied to the inlet 206 of the sprinkler. The rotor assembly 210 is normally urged to its retracted position within housing 204 by a helical spring 260 interposeed between an annular shoulder 262 at the lower end of housing 204, an a sealing ring 264 at the upper end of the housing sealing the space between the rotor assembly 210 and the outer housing 204.

The rotor assembly 210, including its presettable cap 50 for presetting the range of the sprinkler and its presettable ring 32 for presetting the sector angle of the sprinkler, is otherwise of substantially the same construction, and operate in substantially the same manner, as described above with respect to the sprinkler of FIGS. 1–3, and therefore its parts have been correspondingly numbered so as to facilitate understanding its structure and operation.

While the invention has been described with respect to several preferred embodiments, it will be appreciated that these are set forth merely for purposes of example, and that many other variations, modifications and applications of the invention will be apparent.

What is claimed is:

1. A ball-type water sprinkler, comprising:

a mounting device for mounting the sprinkler to a water supply pipe;

a rotor mounted for rotation with respect to said mounting device and to receive water therefrom;

a chamber formed in said rotor and having a first water inlet oriented to direct the water to flow circumferentially of the chamber in a first direction, a second water inlet oriented to direct the water to flow circumferentially thereof in the opposite direction, and an outlet from said chamber;

a ball freely movable within the chamber according to the direction of flow of the water therethrough;

an impact element fixed to the rotor within said chamber so as to be impacted by the ball and to rotate the rotor according to the direction of rotation of the ball therein;

a fixed stop extending axially of the sprinkler and fixed with respect to said mounting device;

a presettable stop also extending axially of the sprinkler and circumferentially presettable with respect to said fixed stop;

a shutter normally coupled to said rotor and to rotate therewith but movable with respect thereto to a first position covering said first inlet and uncovering said second inlet, or to a second position covering said second inlet and uncovering said first inlet;

and actuator means rotatable with said shutter;

said presettable stop being carried by a rotatable ring interposed between said mounting device and said rotor;

said shutter being of a T-configuration, including a first leg adapted to cover and uncover said first inlet, a second leg adapted to cover and uncover said second inlet, and a third leg pivotally mounting said shutter to said actuator means;

said actuator means including an actuator element extending axially of the sprinkler and engageable with said fixed stop to move the shutter to said first position and with said presettable stop to move the shutter to said second position.

2. The sprinkler according to claim 1, wherein:

said actuator means includes an actuator disc having a first projection extending axially from one side of the disc and received within a first opening in the rotor for coupling the actuator disc to the rotor during the rotation of the rotor in one directon;

said actuator disc has a second projection extending axially from the same side of the disc and received within a second opening in the rotor for coupling the actuator disc to the rotor during the rotation of the rotor in the opposite direction;

said actuator element being a third projection extending axially from the opposite side of the disc and engageable with said first and second stops.

3. A ball-type water sprinkler, comprising:

a mounting device for mounting the sprinkler to a water supply pipe;

a rotor mounted for rotation with respect to said mounting device and to receive water therefrom;

a chamber formed in said rotor and having a first water inlet oriented to direct the water to flow circumferentially of the chamber in a first direction, a second water inlet oriented to direct the water to flow circumferentially thereof in the opposite direction, and an outlet from said chamber;

a ball freely movable within the chamber according to the direction of flow of the water therethrough;

an impact element fixed to the rotor within said chamber so as to be impacted by the ball and to rotate the rotor according to the direction of rotation of the ball therein;

a fixed stop fixed with respect to said mounting device;

a presettable stop circumferentially presettable with respect to said fixed stop;

a shutter normally coupled to said rotor to rotate therewith but movable with respect thereto to a first position covering said first inlet and uncovering said second inlet, or to a second position covering said second inlet and uncovering said first inlet;

and actuator means rotatable with said shutter and engageable with said fixed stop to move the shutter to said first position and with said presettable stop to move the shutter to said second position;

characterized in that:

said actuator means includes an actuator disc having a first projection extending axially from one side of the disc and received within a first opening in the rotor for coupling the actuator disc to the rotor during the rotation of the rotor in one directon;

said actuator disc has a second projection extending axially from the same side of the disc and received within a second opening in the rotor for coupling the actuator disc to the rotor during the rotation of the rotor in the opposite direction;

said actuator disc has a third projection extending axially from the opposite side of the disc and engageable with said first and second stops.

4. The sprinkler according to claim 3, wherein said actuator disc includes a stem extending axially thereof from said opposite side of the disc and received within a sleeve fixed to said presettable ring and through which the water is inletted into the sprinkler via said mounting device.

5. The sprinkler according to claim 4, further including a spring interposed between said sleeve and said actuator disc and urging said actuator disc and shutter towards said rotor.

6. The sprinkler according to claim 5, further including a collar interposed between said sleeve and said actuator discs, said latter spring being a coiled spring interposed between said collar and said sleeve.

7. The sprinkler according to claim 1, wherein said presettable ring carries graduation markings indicating the sector angle preset by said presettable ring.

8. The sprinkler according to claim 1, wherein the sprinkler further includes a housing fixed to said mounting device and enclosing said rotor, said fixed stop being fixed to said housing.

9. The sprinker according to claim 1, wherein said fixed stop is fixed to said mounting device.

10. The sprinkler according to claim 1, wherein said impact element fixed within said chamber of the rotor extends radially from an axially-extending surface of the chamber so as to deflect the ball radially inwardly of the chamber.

11. The sprinkler according to claim 1, wherein said impact element fixed within said chamber of the rotor extends axially from a radially-extending surface of the chamber so as to deflect the ball axially of the chamber.

12. The sprinkler according to claim 1, wherein said sprinkler includes a discharge outlet communicating with the outlet from said chamber, and range presetting means for presetting the range of the discharged water.

13. The sprinkler according to claim 12, wherein said range presetting means comprises a presettable cap rotatably mounted on the end of said sprinkler and having an apertured end wall aligned with an open end of the sprinkler to define a discharge slot therewith; said apertured end wall being of helical configuration and of varying inclination with respect to the transverse axis of the sprinkler such that rotating the cap changes the inclination of the discharge slot and thereby the sprinkler range.

14. The sprinkler according to claim 13, wherein said end wall of the cap is formed with a plurality of radially-extending ribs.

* * * * *